US007363682B2

(12) United States Patent
Lim et al.

(10) Patent No.: US 7,363,682 B2
(45) Date of Patent: Apr. 29, 2008

(54) SUCTION HEAD FOR VACUUM CLEANER

(75) Inventors: Jun-Young Lim, Incheon (KR); Myung-Keun Yoo, Gyeonggi-Do (KR); Yong-Won Choi, Daejeon (KR)

(73) Assignee: LG Electronics Inc., Seoul (KR)

( * ) Notice: Subject to any disclaimer, the term of this patent is extended or adjusted under 35 U.S.C. 154(b) by 543 days.

(21) Appl. No.: 10/748,297

(22) Filed: Dec. 31, 2003

(65) Prior Publication Data

US 2005/0015922 A1 Jan. 27, 2005

(30) Foreign Application Priority Data

Jul. 24, 2003 (KR) ..... 10-2003-0051095

(51) Int. Cl.
*A47L 9/04* (2006.01)

(52) U.S. Cl. ..... 15/381; 15/377; 15/363

(58) Field of Classification Search ..... 15/363, 15/377, 380, 381, 22.4, 32
See application file for complete search history.

(56) References Cited

U.S. PATENT DOCUMENTS

| | | | | | |
|---|---|---|---|---|---|
| 1,197,915 | A | * | 9/1916 | Dance | 15/381 |
| 1,689,811 | A | * | 10/1928 | Witt | 15/381 |
| 1,805,203 | A | * | 5/1931 | Brasty | 15/381 |
| 1,820,350 | A | * | 8/1931 | Dance | 15/389 |
| 2,635,278 | A | | 4/1953 | Belknap | |
| 3,483,410 | A | | 12/1969 | Siegelman et al. | |
| 4,020,526 | A | * | 5/1977 | Johansson | 15/364 |
| 4,136,420 | A | * | 1/1979 | Cyphert et al. | 15/321 |
| 4,156,952 | A | * | 6/1979 | Lynch, Jr. | 15/320 |
| 4,430,768 | A | * | 2/1984 | Novinger | 15/381 |
| 5,613,259 | A | | 3/1997 | Craft et al. | |
| 6,148,475 | A | | 11/2000 | Stross et al. | |
| 2003/0037408 | A1 | | 2/2003 | Park | |

FOREIGN PATENT DOCUMENTS

| | | | |
|---|---|---|---|
| CN | 2230570 | Y | 7/1996 |
| CN | 1163740 | A | 11/1997 |
| EP | 0 786 288 | A2 | 7/1997 |
| JP | 63-264030 | A | 10/1988 |
| JP | 7-313411 | A | 12/1995 |

* cited by examiner

*Primary Examiner*—Theresa T Snider
(74) *Attorney, Agent, or Firm*—Birch, Stewart, Kolasch & Birch, LLP

(57) ABSTRACT

The present invention discloses a suction head for a vacuum cleaner, including a casing having a suction port for sucking alien substances from the floor, an agitator rotatably installed inside the suction port, a plurality of brushes being arranged on the agitator in the length direction, an agitator driving unit for driving the agitator to perform reciprocating rotation in a predetermined angle range, and a resonance unit for resonating the reciprocating rotation of the agitator driving unit. The suction head for the vacuum cleaner improves cleaning performance of the vacuum cleaner.

11 Claims, 4 Drawing Sheets

SUCTION HEAD FOR VACUUM CLEANER

This nonprovisional application claims priority under 35 U.S.C. §119(a) on patent application Ser. No(s). 10-2003-0051095 filed in KOREA on Jul. 24, 2003, which is (are) wherein incorporated by reference.

BACKGROUND OF THE INVENTION

1. Field of the Invention

The present invention relates to a suction head for a vacuum cleaner, and more particularly, to a suction head for a vacuum cleaner which can efficiently suck alien substances and prevent the alien substances from getting tangled.

2. Description of the Background Art

Referring to FIG. 1, a conventional vacuum cleaner includes a main body 1 having a fan motor for generating a suction force, a suction tube 2 connected to the suction side of the main body 1, a connection tube 4 connected to the suction tube 2, and a suction head 5 connected to the connection tube 4, for sucking alien substances such as dust from the outside by the suction force generated by the fan motor.

As shown in FIG. 2, the suction head 5 is comprised of a casing 12 having a suction port 11, a suction nozzle 13 for collecting the alien substances sucked from the suction port 11, an agitator 14 rotatably installed inside the suction port 11, and rotated for brushing the alien substances, a plurality of brushes 14*a* being formed on the outside surface of which, a driving motor 15 for providing a driving force for rotating the agitator 14, and a rotational force transmitting unit having a driving pulley 16 connected to a motor shaft of the driving motor 15, for transmitting a rotational force of the driving motor 15 to the agitator 14, a driven pulley 17 mounted in one side of the agitator 14, and a timing belt 18 for connecting the driving pulley 16 to the driven pulley 17.

In the conventional vacuum cleaner, when power is on and the fan motor installed inside the main body 1 is rotated, the suction force is generated in the suction port 11 of the suction head 5 due to the suction force of the fan motor. Alien substances such as dust are sucked from the floor to the suction port 11 by the suction force, and sucked to the main body 1 through the connection tube 4 and the suction tube 2.

Here, when the driving motor 15 of the suction head 5 is rotated, the rotational force of the driving motor 15 is transmitted to the agitator 14 through the driving pulley 16, the timing belt 18 and the driven pulley 17, and thus the agitator 14 is rotated by 360°. The brushes 14*a* formed on the outside surface of the agitator 14 separate alien substances such as dust from the floor by the rotation of the agitator 14, to easily suck dust from the floor.

In the suction head 5 for the conventional vacuum cleaner, the driven pulley 17 connected to the timing belt 18 occupies a predetermined area on the outside surface of the agitator 14, and thus the brushes 14*a* are not formed on the outside surface of the agitator 14 on which the driven pulley 17 is installed. Accordingly, alien substances are not normally brushed in the area where the brushes 14*a* are not formed, and thus not easily sucked to the suction port 11. As a result, cleaning performance of the vacuum cleaner is reduced.

In addition, the agitator is rotated by 360°, and thus thin and long alien substances such as hairs or threads get wound or tangled on the brushes 14*a*, to deteriorate operation effects of the brushes 14*a*. Therefore, cleaning performance of the vacuum cleaner is reduced, and such alien substances need to be removed.

SUMMARY OF THE INVENTION

Therefore, an object of the present invention is to provide a suction head for a vacuum cleaner which can improve cleaning performance of the vacuum cleaner by installing brushes on the whole surface of an agitator of a suction port in the length direction and preventing thin and long alien substances such as hairs or threads from getting tangled, by forming the agitator to perform reciprocating rotation in a predetermined angle range.

Another object of the present invention is to provide a suction head for a vacuum cleaner which can improve cleaning performance of the vacuum cleaner, by efficiently performing reciprocating rotation of an agitator by using a resonance unit for resonating the reciprocating rotation of the agitator.

To achieve these and other advantages and in accordance with the purpose of the present invention, as embodied and broadly described herein, there is provided a suction head for a vacuum cleaner, including: a casing having a suction port for sucking alien substances from the floor; an agitator rotatably installed inside the suction port, a plurality of brushes being arranged on the agitator in the length direction; an agitator driving unit for driving the agitator to perform reciprocating rotation in a predetermined angle range; and a resonance unit for resonating the reciprocating rotation of the agitator driving unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A suction head for a vacuum cleaner in accordance with the present invention will now be described with reference to the accompanying drawings.

Figure 1:
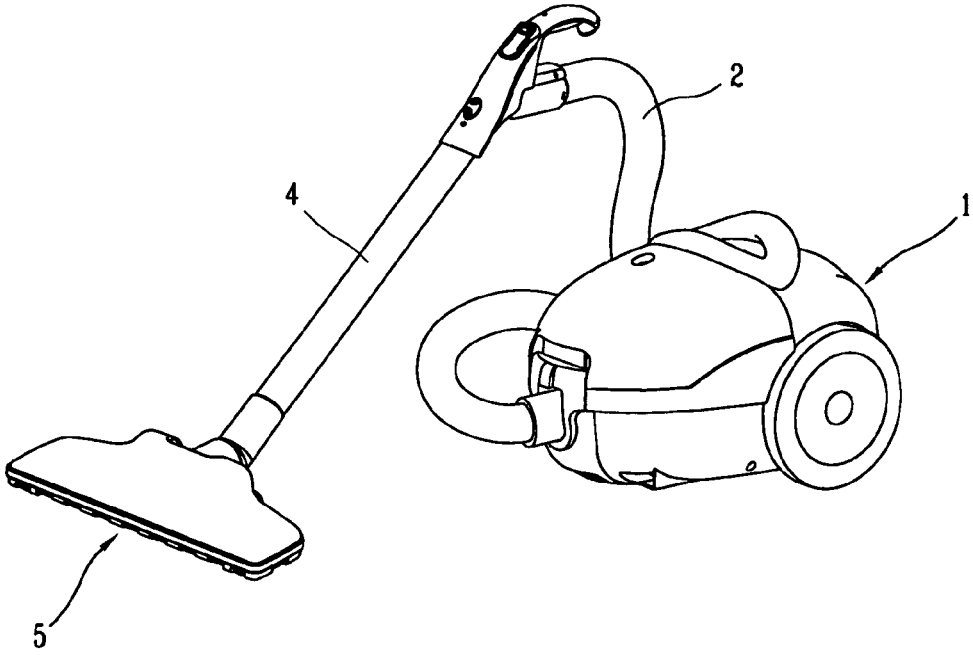
FIG. 1 CONVENTIONAL ART
FIG. 1 is a perspective diagram illustrating a conventional vacuum cleaner.
Figure 2:
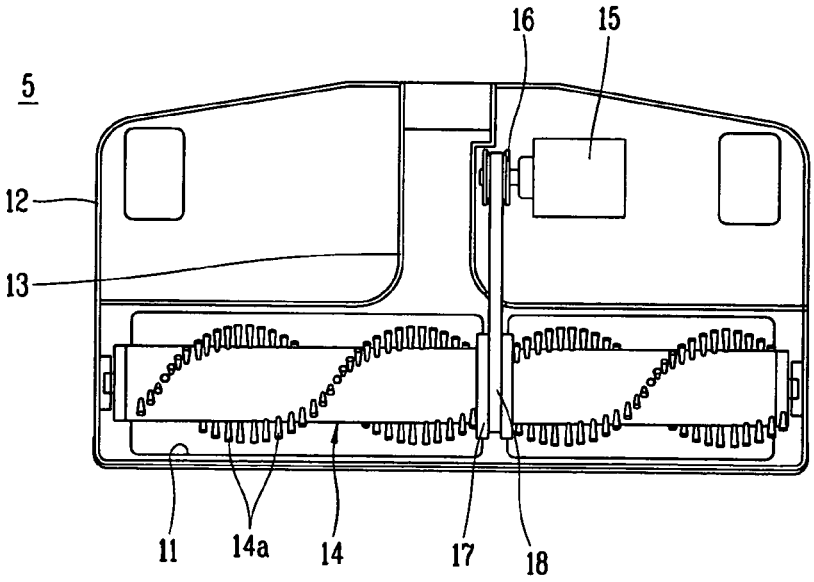
FIG. 2 CONVENTIONAL ART
FIG. 2 is a schematic diagram illustrating a suction head for the conventional vacuum cleaner.
Figure 3:
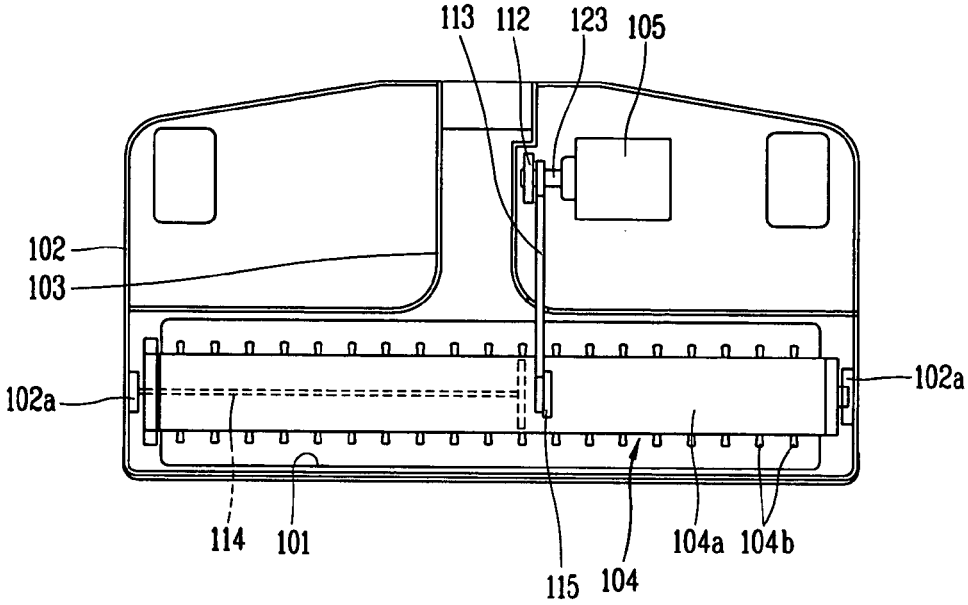
FIG. 3 is a schematic diagram illustrating a suction head for a vacuum cleaner in accordance with a first embodiment of the present invention.
Figure 4:
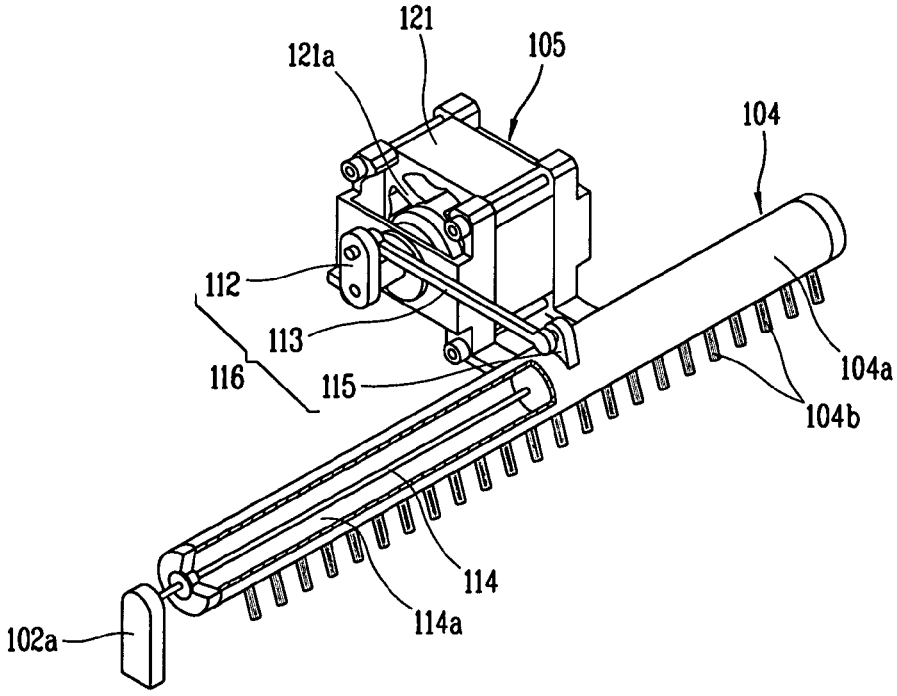
FIG. 4 is a perspective diagram illustrating a driving motor and an agitator installed in the suction head for the vacuum cleaner in accordance with the first embodiment of the present invention.

As illustrated in FIGS. 3 and 4, a suction head for a vacuum cleaner in accordance with a first embodiment of the present invention includes a casing 102 having a suction port 101 for sucking alien substances from the floor in its lower side, a suction nozzle 103 installed inside the casing 102, for collecting the alien substances sucked from the suction port 101, a volume of which being reduced from the suction port 101 to the opposite side, an agitator 104 having a cylindrical agitator body 104*a* rotatably installed inside the suction port 101, and a plurality of brushes 104*b* installed on the outside surface of the agitator body 104*a*, for brushing alien substances from the floor, a driving motor 105 positioned inside the casing 102, for generating a driving force for performing forward/backward reciprocating rotation in a predetermined angle, a driving force transmitting unit 116 for transmitting the driving force of the driving motor 105 to the agitator 104, so that the agitator 104 can perform the reciprocating rotation in a predetermined angle, and a resonance unit for resonating the reciprocating rotation of the driving motor 105.

The brushes 104*b* installed in the agitator 104 are evenly arranged in the length direction of the agitator 104. Preferably, the brushes 104*b* are installed in rows in the length direction of the agitator 104, which is not intended to be limiting. That is, the brushes 104*b* are formed in at least one row in a rotation angle range of the agitator 104. In addition, considering that the agitator 104 is rotated in a predetermined angle range, the brushes 104*b* need not to be installed in the whole circumferential direction of the agitator 140 but limitedly installed in the lower side of the agitator 104 in the length direction, which cuts down manufacturing expenses.

Figure 5A:
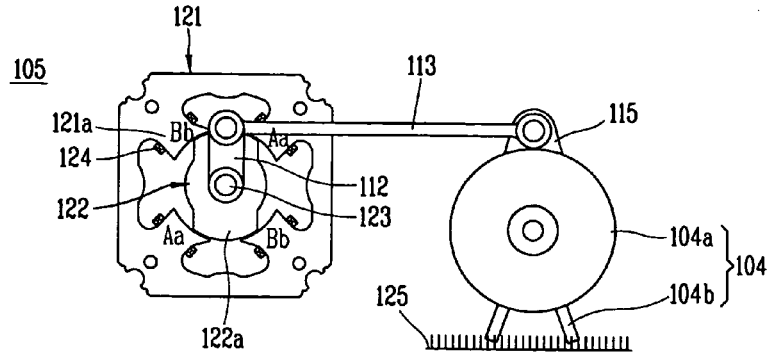
FIGS. 5A to 5D are operation status diagrams illustrating a series of operations of the driving motor and the agitator installed in the suction head for the vacuum cleaner in accordance with a first embodiment of the present invention.

As illustrated in FIG. 5A, the driving motor 105 includes a stator 121 having two pairs of stator side teeth 121*a* protruded from its inside surface in the diagonal direction, and coils 124 wound up on the stator side teeth 121*a*, a rotor 122 having rotor side teeth 122*a* protruded from its both ends, and performing reciprocating rotation between the stator side teeth 121*a*, and a motor shaft 123 inserted into the center of the rotor 122.

The driving force transmitting unit 116 is comprised of a rotary link 112 fixed to the motor shaft 123 of the driving motor 105, for performing reciprocating rotation coaxially to the motor shaft 123, a hinge bracket 115 fixed to one side of the outer circumference of the agitator 104, and a connecting rod 113 having its one end hinge-connected to the rotary link 112 and its other end hinge-connected to the hinge bracket 115, and performing angular reciprocating motion by the reciprocating rotation of the rotary link 112.

The resonance unit includes a torsion bar 114 positioned in a hollow unit 114*a* formed inside the agitator 104 coaxially to a central shaft of the agitator 104, the torsion bar having its one end fixed to the inside of the agitator 104 and its other end fixed to the casing 102 through a spring fixing unit 102*a* mounted on the inside surface of the casing 102.

The operation of the suction head for the vacuum cleaner in accordance with the first embodiment of the present invention will now be described with reference to FIGS. 5A to 5D. Here, the motion directions of each member are seen from the accompanying drawings, which is not intended to be limiting.

When power is transmitted to the vacuum cleaner, the suction force is generated in the suction port 101 of the suction head due to the suction force generated in a main body of the vacuum cleaner, and alien substances such as dust are sucked from the floor 125 to the main body through the suction port 101 by the suction force.

The driving force for performing the reciprocating rotation is generated in the driving motor 105. When the driving force of the driving motor 105 is transmitted to the agitator 104 through the driving force transmitting unit 116, the agitator 104 performs the reciprocating rotation in a predetermined angle range. Alien substances such as dust are separated from the floor 125 by the brushes 104*b* formed on the outside surface of the agitator 104 in the length direction, and sucked through the suction port 101.

Figure 5B:
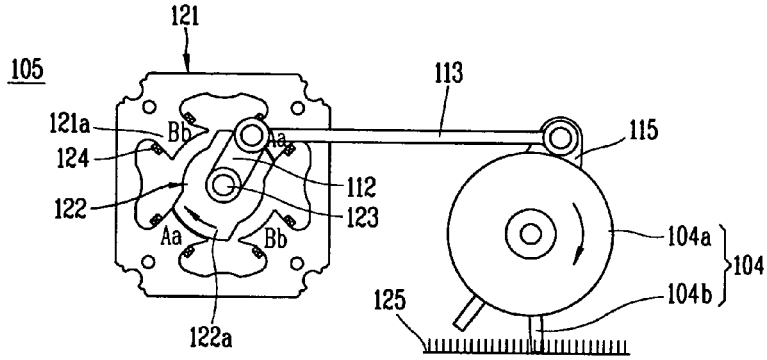
Figure 5C:
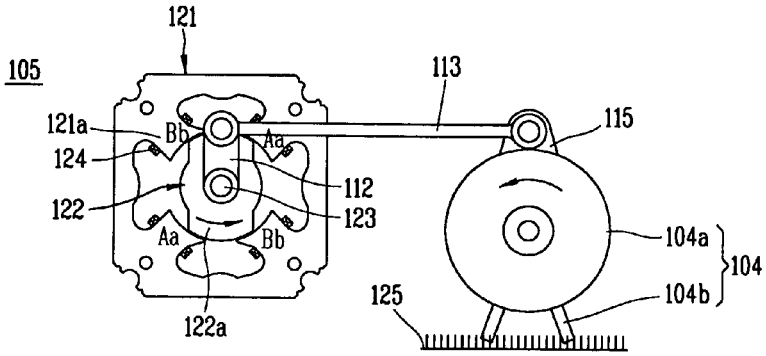

In more detail, when Aa pole of the stator side teeth 121*a* of the driving motor 105 is excited in the diagonal direction, namely Aa-Aa direction in the static equilibrium state as shown in FIG. 5A, the rotor 122 is rotated in the exited direction (clockwise direction seen from the drawings) as shown in FIG. 5B, the rotary link 112 connected to the motor shaft 123 of the driving motor 105 is rotated in the clockwise direction, and the connecting rod 113 connected to the rotary link 112 moves toward the agitator 104 to rotate the agitator 104 in the clockwise direction. Here, the agitator 104 is rotated in the anticlockwise direction by a restitution force of the torsion bar 114. As illustrated in FIG. 5C, the rotor 122 returns to the initial operation state due to the rotation of the agitator 104.

Figure 5D:
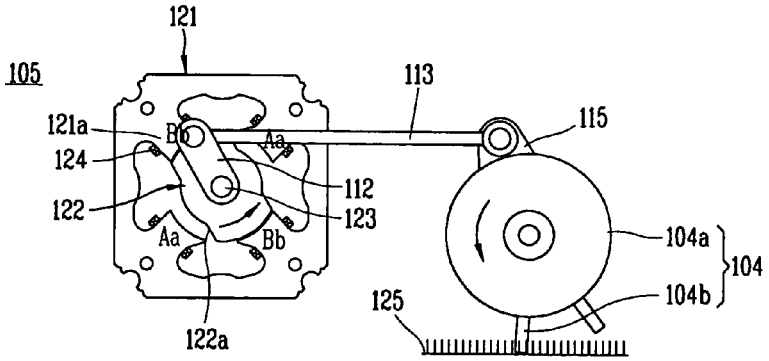

In this state, when Bb pole of the stator side teeth 121*a* of the driving motor 105 is excited in the diagonal direction, namely Bb-Bb direction, the rotor 122 is rotated in the excited direction (anticlockwise direction seen from the drawings) as shown in FIG. 5D, the rotary link 112 connected to the motor shaft 123 is rotated in the anticlockwise direction, and the connecting rod 113 connected to the rotary link 112 moves to rotate the agitator 104 in the anticlockwise direction. Here, the agitator 104 is re-rotated in the clockwise direction due to the restitution force of the torsion bar 114. As depicted in FIG. 5A, the rotor 122 returns to the initial operation state due to the clockwise rotation of the agitator 104. The rotation and resonance are repeated at a high speed.

Accordingly, the agitator 104 performs the reciprocating rotation at a high speed in the predetermined angle range. The brushes 104*b* brush the floor 125 by the rotation of the agitator 104, to easily suck alien substances from the floor 125.

The suction head for the vacuum cleaner in accordance with the first embodiment of the present invention prevents thin and long alien substances such as hairs or threads from getting wound or tangled on the agitator, by forming the agitator to perform the reciprocating rotation in the predetermined angle range, and brushes the whole area of the suction head, by evenly installing the brushes on the whole surface of the agitator in the length direction, thereby improving cleaning performance of the vacuum cleaner.

The suction head for the vacuum cleaner includes the resonance unit for resonating the reciprocating rotation of the driving motor, thereby stably rotating the agitator at a high speed.

A suction head for a vacuum cleaner in accordance with a second embodiment of the present invention will now be explained with reference to FIG. 6. Same reference numerals are used for the same parts as the first embodiment of the present invention.

Figure 6:
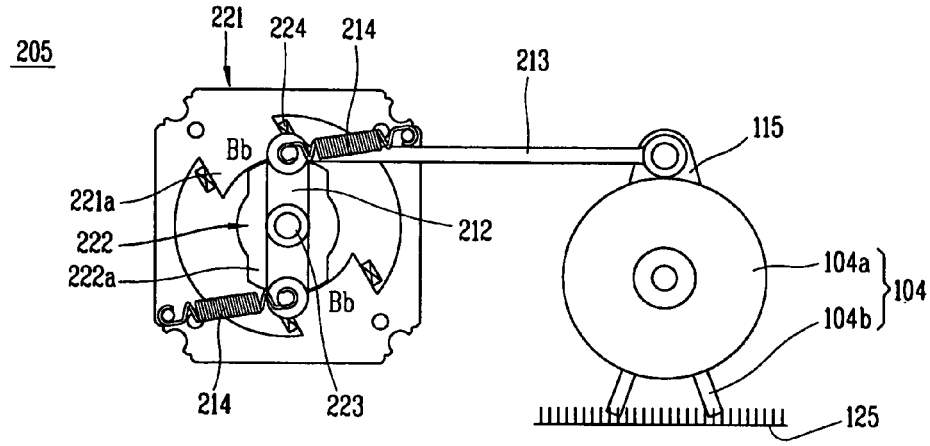
FIG. 6 is a schematic diagram illustrating a driving motor and an agitator installed in a suction head for a vacuum cleaner in accordance with a second embodiment of the present invention.

Referring to FIG. 6, in the suction head for the vacuum cleaner, a driving motor 205 includes a stator 221 having one pair of stator side teeth 221*a* protruded from its inside surface in the diagonal direction, and coils 224 wound up on the stator side teeth 221*a*, a rotor 222 having rotor side teeth 222*a* protruded from its both ends, and performing reciprocating rotation between the stator side teeth 221*a*, and a motor shaft 223 inserted into the center of the rotor 222.

A resonance unit for resonating the rotary motion of the driving motor 205 is comprised of a pair of coil springs 214 having their one side ends fixed respectively to both ends of a rotary link 212 whose center is coaxially connected to the motor shaft 223 of the driving motor 205, and their other side ends fixed respectively to the driving motor 205. Here, the coil springs 214 can be fixed to the inside surface of the casing 102 as well, and the coil springs 214 are installed in the area where the stator side teeth 221*a* of the stator 221 are not formed.

On the other hand, as described above, the rotary link 212 and the agitator 104 are connected through a connecting rod 213 hinge-connected to the hinge bracket 115 installed in one side of the outer circumference of the agitator 104 and the rotary link 212, respectively.

In this state, when Bb pole of the stator side teeth 221*a* of the driving motor 205 is excited in the diagonal direction, namely Bb-Bb direction, the rotor 222 is rotated in the excited direction (anticlockwise direction seen from the drawings), the rotary link 212 connected to the motor shaft 223 of the driving motor 205 is rotated in the anticlockwise direction, and the connecting rod 213 connected to the rotary link 212 moves to rotate the agitator 104 in the anticlockwise direction. When power of Bb pole of the teeth 221*a* is intercepted, the rotor 222 is rotated in the clockwise direction by a restitution force of the coil spring 214 installed in the opposite side of the stator side teeth 221*a*, the rotary link 212 connected to the motor shaft 223 is rotated in the clockwise direction, and the connecting rod 213 connected to the rotary link 212 moves to rotate the agitator 104 in the clockwise direction. The rotation and resonance are repeated at a high speed. Therefore, the agitator 104 performs the reciprocating rotation at a high speed in a predetermined angle range. The brushes 104*b* brush the floor 125 by the rotation of the agitator 104, to easily suck alien substances from the floor 125. The suction head for the vacuum cleaner in accordance with the second embodiment of the present invention shows the same operations and effects as the first embodiment described above.

A suction head for a vacuum cleaner in accordance with a third embodiment of the present invention will now be explained with reference to FIG. 7. Same reference numerals are used for the same parts as the first and second embodiments of the present invention.

Figure 7:
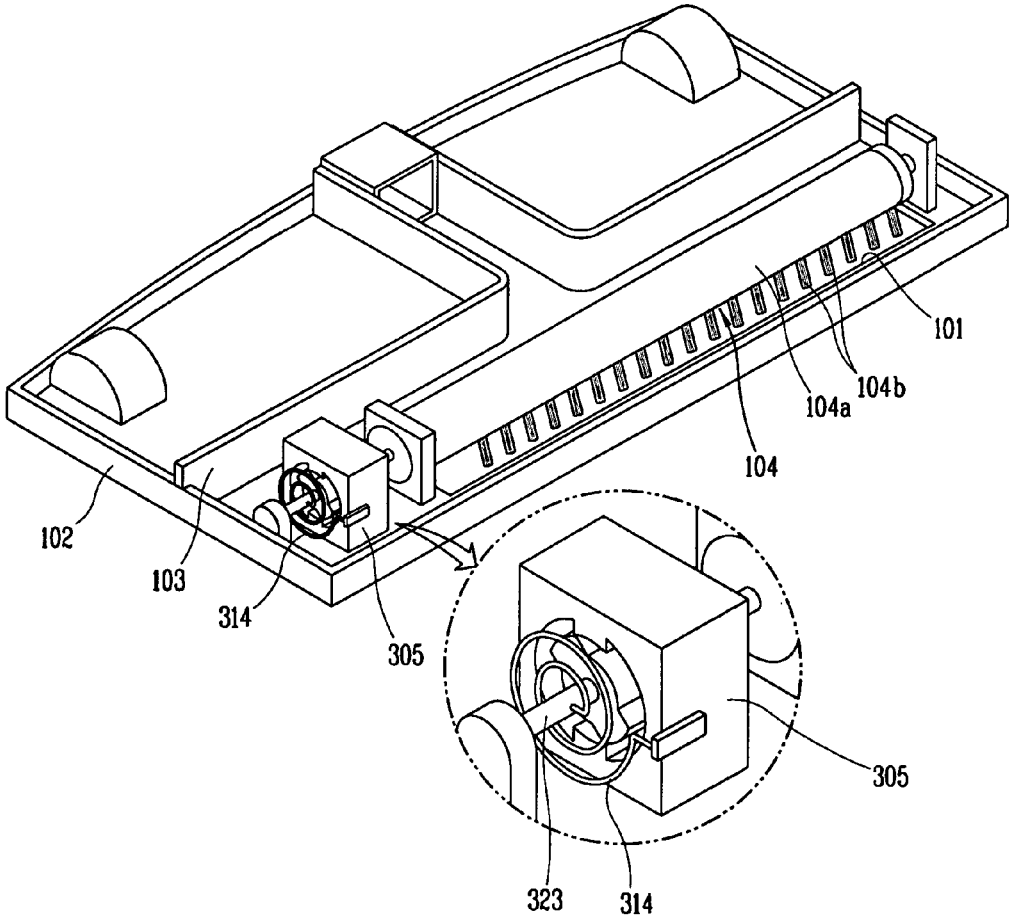
FIG. 7 is a schematic diagram illustrating a suction head for a vacuum cleaner in accordance with a third embodiment of the present invention.

As shown in FIG. 7, the suction head for the vacuum cleaner in accordance with the third embodiment of the present invention includes a casing 102 having a suction port 101 for sucking alien substances from the floor in its lower side, a suction nozzle 103 installed inside the casing 102, for collecting the alien substances sucked from the suction port 101, a volume of which being reduced from the suction port 101 to the opposite side, an agitator 104 having a cylindrical agitator body 104*a* rotatably installed inside the suction port 101, and a plurality of brushes 104*b* installed on the outside surface of the agitator body 104*a*, for brushing alien substances, a driving motor 305 positioned inside the casing 102, for generating a driving force for performing forward/backward reciprocating rotation in a predetermined angle, and a resonance unit for resonating the reciprocating rotation of the agitator 104.

The inside components of the driving motor 305 are identical to the first or second embodiment of the present invention.

The driving motor 305 is installed in one side of the agitator 104 in the length direction so that a motor shaft 323 can be coaxially connected to a central shaft of the agitator 104.

In addition, the resonance unit includes a spiral spring 314 having its one end fixed to the motor shaft 323 and its other end fixed to the outside surface of the driving motor 305. Here, the other side of the spiral spring 314 can be fixed to the inside surface of the casing 102 as well as the outside surface of the driving motor 305.

When the driving motor 305 is rotated in the forward/backward direction in a predetermined angle range, the agitator 104 fixed to the motor shaft 323 is rotated in the forward/backward direction in a predetermined angle range. Here, the rotary motion of the agitator 104 is resonated due to an elastic restitution force of the spiral spring 314. Accordingly, the agitator 104 can be stably rotated at a high speed in the forward/backward direction in the predetermined angle range.

The suction head for the vacuum cleaner in accordance with the third embodiment of the present invention prevents thin and long alien substances such as hairs or threads from getting wound or tangled on the agitator, by forming the agitator to perform the reciprocating rotation in the predetermined angle range, and brushes the whole area of the suction head, by evenly installing the brushes on the whole surface of the agitator in the length direction, thereby improving cleaning performance of the vacuum cleaner.

Moreover, in the suction head for the vacuum cleaner, the motor shaft of the driving motor is connected coaxially to the central shaft of the agitator, so that the driving force of the driving motor can be transmitted to the agitator without using a special driving force transmitting unit. As a result, the whole structure is simplified and manufacturing expenses are cut down.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A suction head for a vacuum cleaner, comprising:

a casing having a suction port for sucking alien substances from a floor;

an agitator roll rotatably installed inside the suction port, a plurality of brushes being arranged on the agitator roll in the length direction;

an agitator roll driving unit including a rotating driving motor having a drive shaft with a rotating lever attached thereto for driving the agitator roll to perform reciprocating rotation of the agitator roll in a predetermined angle range and a driving force transmitting unit for transmitting the driving force of the driving motor to the agitator roll; and a resonance unit for resonating the reciprocating rotation of the agitator driving unit, wherein the resonance unit comprises a spiral spring of which an end is fixed to the drive shaft of the driving motor, and another end is fixed to the driving motor or the casing.

2. The suction head of claim 1, wherein the brushes are evenly arranged at regular intervals in the length direction of the agitator roll.

3. The suction head of claim 1, wherein the brushes are arranged in a plurality of rows in the length direction of the agitator roll.

4. The suction head of claim 1, further comprising a suction nozzle installed inside the casing, for collecting the alien substances sucked from the suction port, a volume of which being reduced from the suction port to the opposite side.

5. A suction head for a vacuum cleaner, comprising:

a casing having a suction port for sucking alien substances from a floor;

an agitator rotatably installed inside the suction port, a plurality of brushes being arranged on the agitator in the length direction;

an agitator driving unit for driving the agitator to perform reciprocating rotation in a predetermined angle range; and a resonance unit for resonating the reciprocating rotation of the agitator driving unit;

wherein the agitator driving unit comprises:

a driving motor for generating a driving force for performing forward/backward reciprocating rotation in a predetermined angle; and a driving force transmitting unit for transmitting the driving force of the driving motor to the agitator; and wherein the driving force transmitting unit comprises:

a rotary link fixed to a motor shaft of the driving motor and rotated coaxially to the motor shaft;

a hinge bracket fixed to one side of the outer circumference of the agitator; and a connecting rod of which an end is hingedly connected to a position of the rotary link eccentric from the rotation center of the rotary link, and another end is hingedly connected to the hinge bracket.

6. The suction head of claim 5, wherein the resonance unit comprises a pair of coil springs of which one side ends are fixed to both ends of the rotary link, and the other side ends are fixed to the driving motor or the casing.

7. A suction head for a vacuum cleaner, comprising:

a casing having a suction port for sucking alien substances from a floor;

an agitator rotatably installed inside the suction port, a plurality of brushes being arranged on the agitator in the length direction;

an agitator driving unit for driving the agitator to perform reciprocating rotation in a predetermined angle range; and a resonance unit for resonating the reciprocating rotation of the agitator driving unit;

wherein the agitator driving unit comprises:

a driving motor for generating a driving force for performing forward/backward reciprocating rotation in a predetermined angle; and a driving force transmitting unit for transmitting the driving force of the driving motor to the agitator; and wherein the resonance unit comprises a torsion bar positioned in the agitator coaxially to a central axis of the agitator, the torsion bar of which an end is fixed to the agitator, and another end is fixed to the casing.

8. A suction head for a vacuum cleaner, comprising:

a casing having a suction port for sucking alien substances from a floor;

an agitator rotatably installed inside the suction port, a plurality of brushes being arranged on the agitator in the length direction;

an agitator driving unit for driving the agitator to perform reciprocating rotation in a predetermined angle range; and a resonance unit for resonating the reciprocating rotation of the agitator driving unit;

wherein the agitator driving unit comprises a forward/backward rotation motor for generating a driving force for performing forward/backward reciprocating rotation in a predetermined angle, a motor shaft of which being connected to the agitator, coaxially to the central axis of the agitator.

9. The suction head of claim 8, wherein the resonance unit comprises a spiral spring of which an end is fixed to the motor shaft of the driving motor, and another end is fixed to the driving motor or the casing.

10. A suction head for a vacuum cleaner, comprising:

a casing having a suction port for sucking alien substances from a floor;

an agitator rotatably installed inside the suction port, a plurality of brushes being arranged on the agitator in the length direction;

an agitator driving unit for driving the agitator to perform reciprocating rotation in a predetermined angle range; and a resonance unit for resonating the reciprocating rotation of the agitator driving unit;

wherein the resonance unit comprises a torsion bar positioned in the agitator coaxially to a central axis of the agitator, the torsion bar of which an end is fixed to the agitator, and another end is fixed to the casing.

11. A suction head for a vacuum cleaner, comprising:

a casing having a suction port for sucking alien substances from a floor;

an agitator rotatably installed inside the suction port, a plurality of brushes being arranged on the agitator in the length direction;

an agitator driving unit for driving the agitator to perform reciprocating rotation in a predetermined angle range; and a resonance unit for resonating the reciprocating rotation of the agitator driving unit;

wherein the resonance unit comprises a spiral spring of which an end is fixed to a motor shaft of a driving motor, and another end is fixed to the driving motor or the casing.

* * * * *